United States Patent [19]

Woods

[11] Patent Number: 4,578,669

[45] Date of Patent: Mar. 25, 1986

[54] REMOTE SWITCH POSITION INDICATOR

[75] Inventor: Allan O. Woods, Houston, Tex.

[73] Assignee: Hydril Company, Los Angeles, Calif.

[21] Appl. No.: 530,962

[22] Filed: Sep. 12, 1983

[51] Int. Cl.[4] ..... G08B 26/00

[52] U.S. Cl. ..... 340/518; 340/500; 340/509; 340/512; 340/513; 340/524; 340/505

[58] Field of Search ..... 340/518, 500, 506, 512, 340/513, 514, 505, 825.05, 825.06–825.1, 825.11, 825.29, 825.42, 825.43, 825.54, 825.59, 825.88–825.91, 509, 524, 525, 644, 645

[56] References Cited

U.S. PATENT DOCUMENTS

| | | | |
|---|---|---|---|
| 3,716,834 | 2/1973 | Adams | 340/505 |
| 4,144,528 | 3/1979 | Johnson, Sr. | 340/518 |
| 4,262,286 | 4/1981 | Tanigawa | 340/518 |
| 4,422,067 | 12/1983 | Clark et al. | 340/501 |
| 4,528,610 | 7/1985 | Payne | 340/505 |

FOREIGN PATENT DOCUMENTS

| | | | |
|---|---|---|---|
| 1465995 | 3/1977 | United Kingdom | 340/513 |

*Primary Examiner*—Donnie L. Crosland
*Attorney, Agent, or Firm*—Dodge, Bush & Moseley

[57] ABSTRACT

A remote sensing and indicating system for monitoring and displaying at a central operating location the state or position of a remotely located multiple state element. The multiple state element may be a subsea valve which may be either in an open state or a closed state. The system electronically scans valve position switches, stores data indicating the position and drives lamps to display valve position. Switches at the remotely located valve are selectively closed in response to the state of the valve. The switches are connected to the central location by only two leads.

22 Claims, 5 Drawing Figures

REMOTE LOCATION
CENTRAL LOCATION
PANEL LAMPS
OPEN
LO
CLOSED
LC
VAC
LAMP DRIVERS
80
Q6
Q7
R10
R20
R19
CR7
R60
CR8
Q3
Q4
+V1
DECODER STORAGE
70
Z4
Z3
R30
R40
LEVEL SHIFTER/ LIMITER
60
CR5
CR6
CR4
CR3
R50
R70
R80
Q5
RECEIVER/AMP. INTEGRATOR
50
R90
R100
R110
C1
Z2
+V2
-V2
CR21
CR41
CR61
CR81
CR11
CR31
CR51
CR71
20
22
24
29
30
31
32
34
44
45
51
61
62
72
71
A
B
C
D

REMOTE SWITCH POSITION INDICATOR

BACKGROUND OF THE INVENTION

1. Field of the Invention

The invention relates generally to an indicator system for remotely sensing and indicating first, second and third status conditions of a three state element. More particularly, the invention relates to a remote switch position scanner and display system for scanning remotely located switches which are responsive to a multi-state element such as a valve or the like wherein the position of the switches are sensed and displayed at a central location. The switches may be not only responsive to an operating element such as a valve but also may be responsive to tripped or closed circuit breakers, out of limit condition indicators, and the like.

2. Description of the Prior Art

In prior art remote scanning and indicating systems, the number of electrical conductors has equaled the number of switches to be scanned and sensed plus at least one common conductor. These prior art systems are disadvantageously expensive when large numbers of elements are to be remotely scanned because a large number of conductors have been required for the long cable runs.

The prior art systems also have lighted indicator lamps at the central location with the interrogating signal. Where extremely long conductor runs exist between the remote location and the central control location, the inductance of the conductors has required that the frequency of interrogatory signals be low with the result that the lamp or other indicators flicker in response to the low frequency driving the lamp.

Thus, it is an object of the invention to provide a new and improved remote scanning and indicating system which overcomes the disadvantages of the prior art.

It is another object of the invention to provide a remote scanning and indicating system requiring but two conductors per element to be sensed.

It is a further object of the invention to provide control electronics for the remote scanning and indicating system which stores the status of the switches to be sensed and control indicator lamps driven by a sixty cycle source by opening or completing one or more closed lamp circuits.

SUMMARY OF THE INVENTION

These objects and other advantages and features of the invention are provided in the novel indicator system for remotely sensing and indicating the first and second conditions of a two state element or the first, second and third conditions of a three state element. The element to be sensed may be a remotely disposed valve being in an opened or closed position, the open and closed positions being the first and second state conditions of the valve. The system also indicates the third state of such a valve when the valve is in a transit condition where the valve is being moved from its open to its closed position.

The system includes a first switch means responsive to the element to be sensed for closing when the element is in a first state and for opening when the element is in a second state. A second switch means is provided for opening when the element is in the first state and for closing when the element is in the second state.

A first diode means connected in series with the first switch means is provided for conducting only positive current through the closed first switch means. A second diode means connected in series with the second switch means is provided for conducting only negative current through the closed second switch means. The first diode-first switch series connection is connected in parallel with the second diode-second switch series connection forming a parallel connection. The switches and diode means are disposed in a remote location so that they may be responsive to the status of the element to be sensed. A pair of conductors is provided between the remote location and the central location. Of the pair, a first conductor is connected to one end of the parallel connection and a second conductor is connected to the other end of the parallel connection.

At the central location, circuit means are disposed for applying to the first conductor a driving oscillating signal that is substantially symmetrical about a reference level. Circuit means also disposed at the central location is responsive to positive half cycles on the second conductor for generating a first continuous output signal indicative that the element is in a first state. Circuit means are also provided at the central location responsive to negative half cycles on the second conductor for generating a second continuous output signal indicative that the element is in a second state. When neither the first or second continuous output signals are generated by the circuit means, such lack of first or second continuous output signals is indicative that the element is in the third state which might be, for example, the transit state where the element is being moved from one state to another.

A first lamp circuit means is provided which is responsive to the first continuous output signal for lighting a first lamp means providing a visual indication that the element that is scanned is in the first state. Likewise, a second lamp circuit means is provided which is responsive to the second continuous output signal for lighting a second lamp means to indicate that the element being scanned is in the second state.

A preferred embodiment of the invention is where the element to be sensed is a subsea gate valve wherein the stem of the valve is in a first state when the valve is closed and in a second state when the valve is open and a third state when the valve is being moved from the open to the closed or from the closed to the open position.

According to the invention, the first and second switch means each comprise at least one reed proximity switch. The first and second switch means are disposed axially apart from each other in a housing through which the valve stem moves axially from the valve closed state to the valve open state. The valve operator stem includes two magnets wherein in the open state of the valve, one magnet of the valve operator stem is disposed adjacent the second switch means, the magnet acting to close only the second switch means. In the closed state of the valve, the other magnet of the valve operator stem is disposed adjacent the first switch means acting to close only the first switch means. When the valve is being moved from the open to the closed or the closed to the open positions, the magnets of the valve operator stem are displaced either side of the first and second switches and do not close either the first or the second switch means.

The first and second switch means are preferably each a set of four reeds comprising a series connection of two groups of two parallel connected switches. The first diode means is preferably a set of four diodes comprising a parallel connection of two sets of two series connected diodes, the diodes being connected to conduct positive current but to prevent negative current through the first switch means. The second diode means is likewise a set of four diodes comprising a parallel connection of two sets of two series connected diodes where the diodes are connected to conduct negative current but to prevent positive current through the second switch means.

The circuit means for applying an oscillating signal to the first conductor includes an oscillator circuit means for generating a rectangular pulse signal, a flip flop means responsive to the rectangular signal for generating a square wave signal, a level shifter means responsive to the square wave signal for generating a square wave signal substantially symmetrical about a reference level and a current limited driver means responsive to the symmetrical square wave signal for generating an oscillating current signal substantially symmetrical about the reference level.

The circuit means for generating a first continuous output signal comprises an inverter/amplifier circuit means for inverting and amplifying the positive half cycles received on the second conductor indicative that the element to be sensed is in the first state, the outcome of the output of the inverter circuit being negative half cycles corresponding to the positive half cycles received from their remote location. A level shifter circuit is provided which is responsive to the negative half cycles for generating a doubly inverted positive half cycle signal. A quadrature signal generator means responsive to the driving oscillating signal is provided for generating a lagging oscillating signal that is ninety degrees trailing behind the driving oscillating signal. A flip flop circuit means is provided which is responsive to the lagging oscillating signal and to the doubly inverted positive half cycle signal for generating the first continuous output signal indicating that the element that is being scanned is in the first state so long as the doubly inverter positive half cycle signal is applied to the flip flop circuit.

The circuit means for generating the second continuous output signal includes an inverter/amplifier circuit means for inverting and amplifying the negative half cycles received on the second conductor indicating that the element being scanned is in the second state. The output of the inverter circuit is an inverter signal of positive half cycles corresponding to the negative half cycles received on the second conductor. A limiter circuit means is provided for generating a clamped inverted signal by clamping the amplitude of the inverted signal of positive half cycles to a pre-specified level. The quadrature signal generator means responsive to the driving oscillator signal is provided for generating a leading oscillating signal which is ninety degrees ahead of said driving oscillating signal. Another flip flop circuit means is provided responsive to the leading oscillating signal and to the clamped inverted signal for generating the second continuous output signal indicative that the element being scanned is in its second state.

The first lamp means comprises a first lamp in a first closed circuit with an alternating cycle voltage source and a first triac element. The first continuous output signal when present is applied to a first emitter follower circuit the output of which is applied to the control terminal of the first triac element. When the signal is applied to the control terminal of the first triac element, the alternating current flows in the closed first series circuit and lights the lamp indicating that the element being sensed is in its first state. The second lamp means is similar to the first in that a second lamp in a second closed circuit with an alternating cycle voltage source and a second triac element. When the second continuous output signal is present, it is applied to a second emitter follower circuit the output of which is applied to the control terminal of the second triac element for allowing alternating current to flow in the closed second series circuit and lighting the second lamp indicating that the element being scanned is in its second state.

BRIEF DESCRIPTION OF THE DRAWINGS

The objects, advantages and features of the invention will become more apparent by reference to the drawings which are appended hereto and wherein like numerals indicate like parts and wherein an illustrative embodiment of the invention is shown of which:

FIG. 1A illustrates the valve in an open position, and FIG. 1B illustrates the valve in a closed position;

DESCRIPTION OF THE INVENTION

Figure 1B:
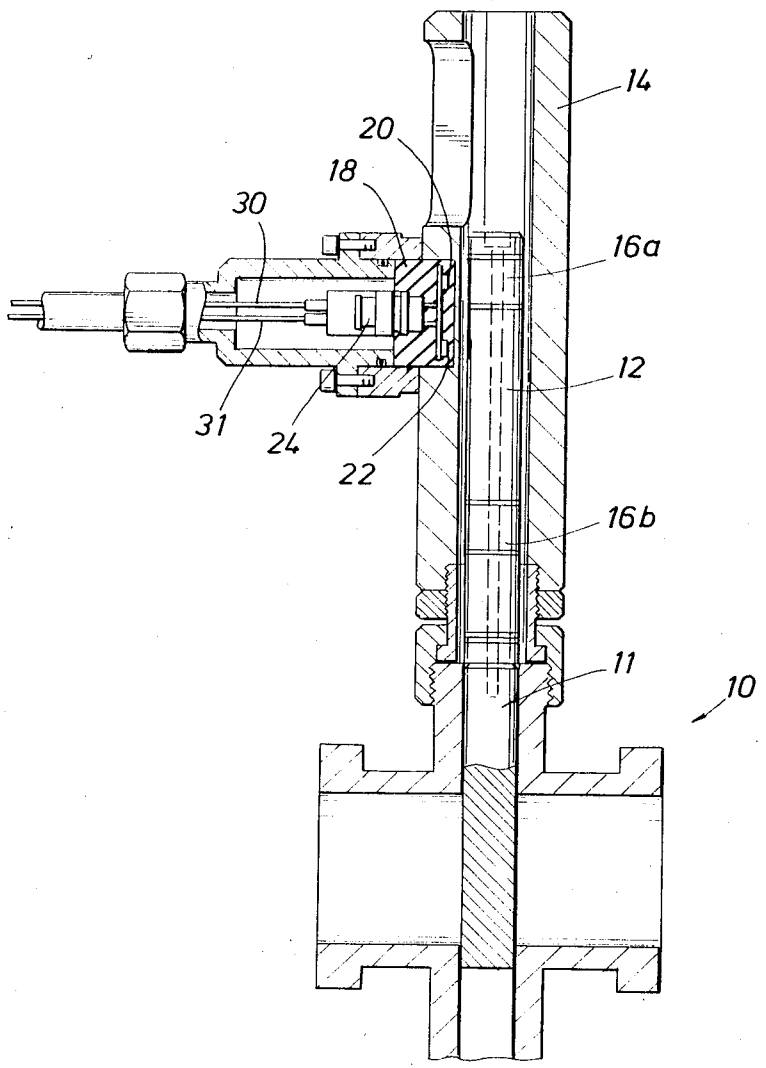
FIGS. 1A and 1B show a remotely disposed element, the status of which is to be sensed where in the preferred embodiment, the element is a gate valve in which the valve operator stem has two magnets disposed thereon for operating switches mounted in proximity thereto in the valve operator housing, and where
Figure 1A:
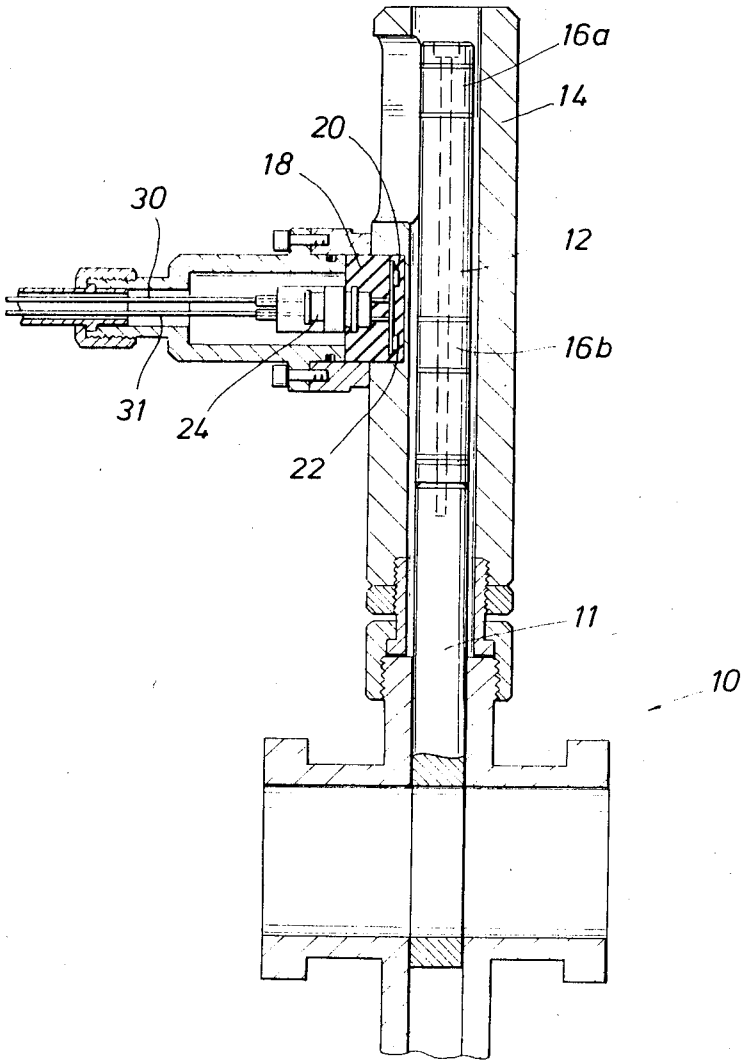

FIGS. 1A and 1B illustrate a gate valve, preferably a subsea gate valve, the status of which is desired to be scanned and indicated at a remote central location. FIG. 1A shows the gate valve 10 in an open position while FIG. 1B shows the gate valve 10 in a closed position. A valve operator stem 12 is provided to move axially within a housing 14 in tandem with the movement of the gate 11 of the valve 10. Magnets **16*a* and 16*b* are disposed on the valve operator stem 12. A sensor assembly 18 is provided in the valve operator housing 14 and includes first and second switch means 20 and 22**. Preferably, the switch means are one or more reed proximity switches which responsively close when in the proximity of a magnetic field.

As shown in FIG. 1A when the valve 10 is in an open position, the magnet **16*b* acts to close second switch means 22. In the closed position illustrated in FIG. 1B, the valve stem 12 has been moved down with the gate 11 until magnet 16*a* is adjacent the first switch means 20 thereby closing the first switch means 20. Since the second switch means 22 is no longer in proximity to the magnet 16*b*, it is in its open condition. Likewise, in FIG. 1A when the valve 10 is in the open condition first switch means 20 is open because magnet 16*a* is not in proximity thereto. Also illustrated in FIGS. 1A and 1B is a diode housing 24 and leads 30 and 31** which connect the sensing diodes and switches to the central location.

Figures 2, 4:
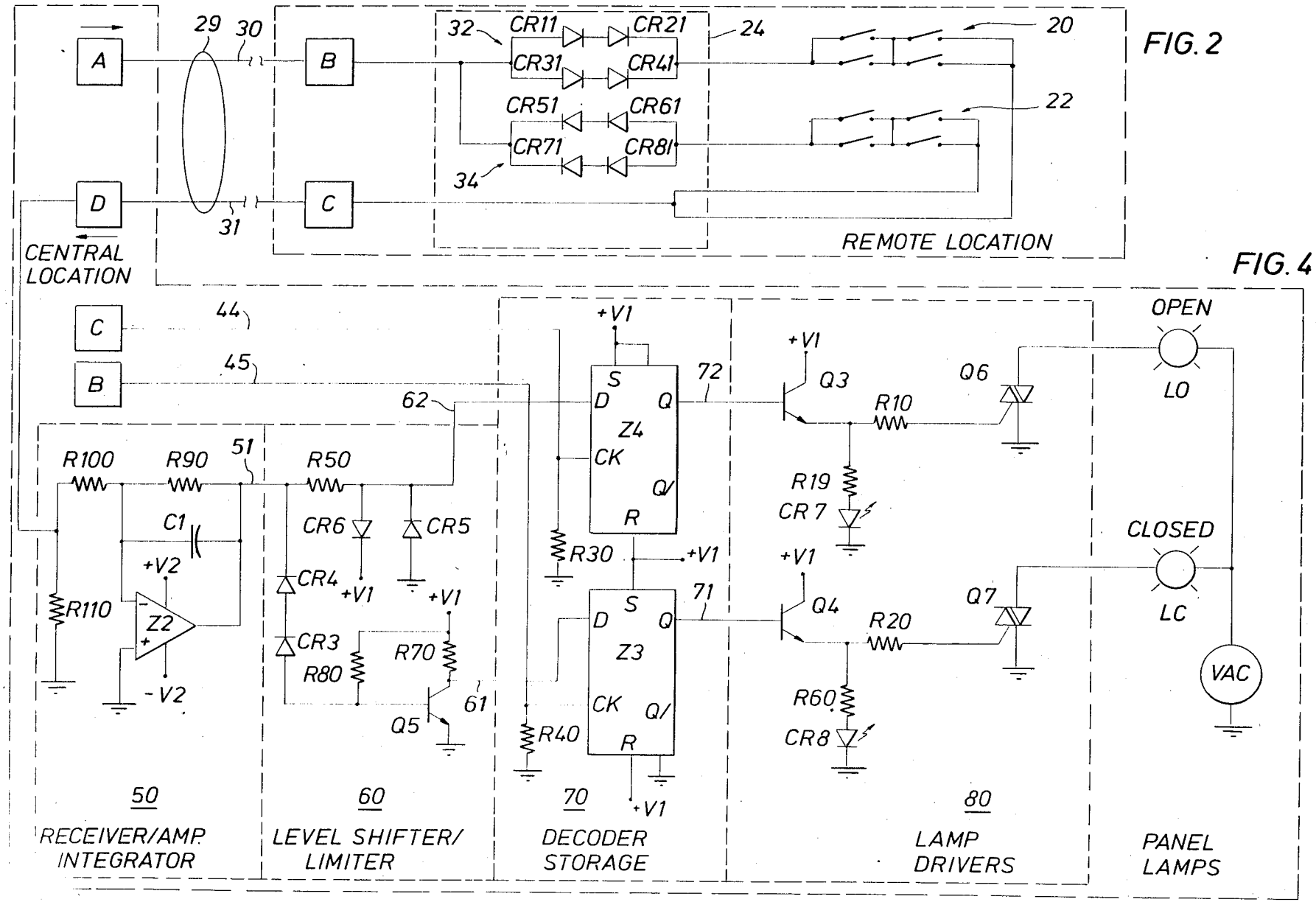
FIG. 2 is an electrical schematic of the switches and steering diodes connected therewith and illustrates that two conductors of a cable are provided between the remote location and the central electronic and indicating section of the system.
FIG. 4 illustrates the interpretation circuitry responsive to signals after they have been transmitted to the remote switches and also illustrates the indicating light means according to the invention.

FIG. 2 illustrates the preferred embodiment of the connection of the sensing switches 20 and 22 and to diodes in a housing 24. Preferably, the first switch means 20 and second means 22 are reed proximity switches series connected in two groups of two parallel connected switches. Likewise, the diode means 32 and 34 connected in series with the switches are preferably four diodes where two groups of two series connected diodes are connected in parallel. The number of diodes and number of switches provided as illustrated in FIG. 2 provides redundancy for insuring long life of the scanning and steering elements where they may be provided in a subsea location for a long period of time. Connecting the sensing diodes and switches to a central location is a cable pair 29 comprising two conductors 30 and 31.

Figure 3:
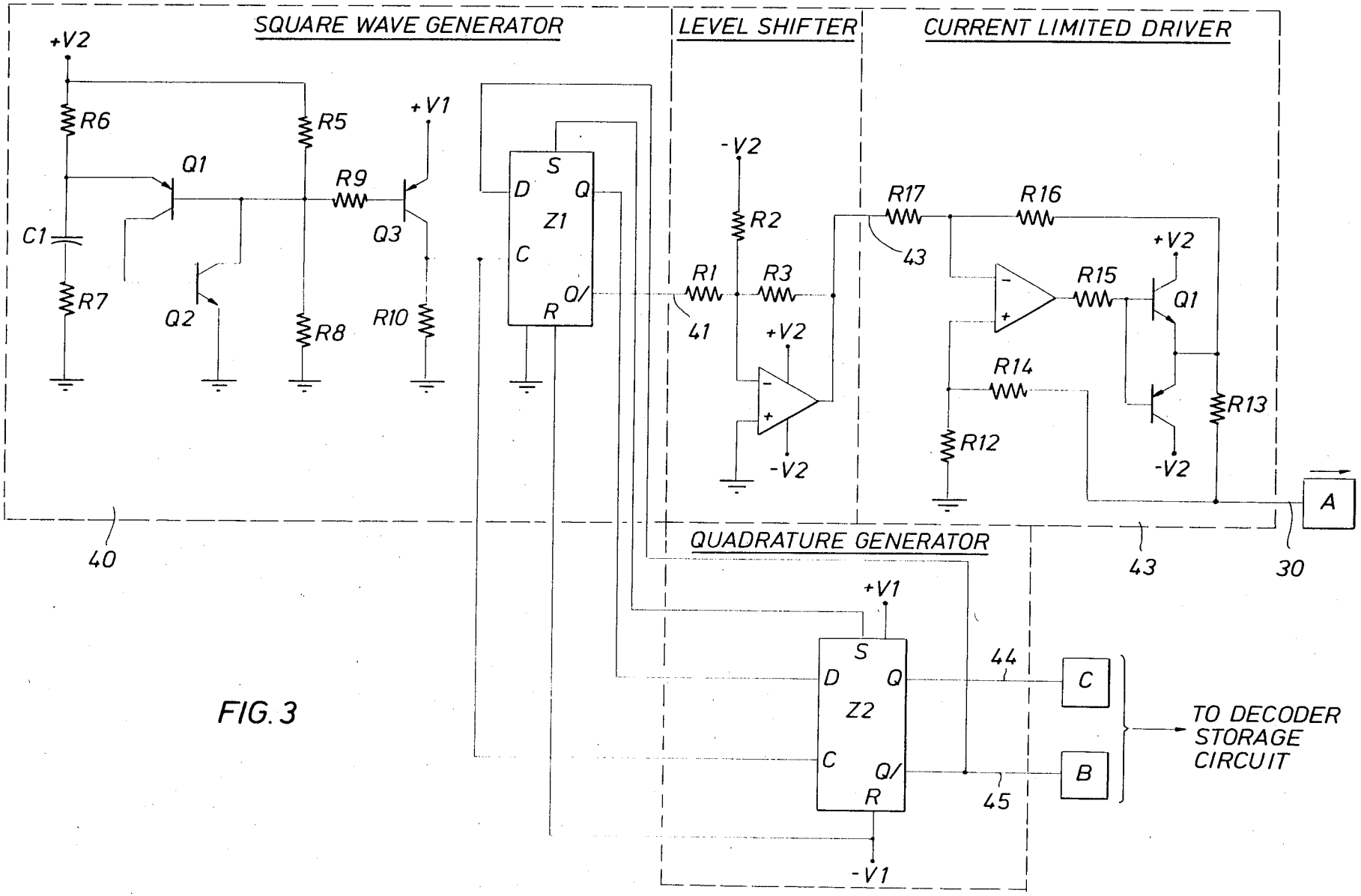
FIG. 3 illustrates the generation of scanning and sensing signals applied to one of the conductors extending between the central location and the remote location.

FIG. 3 illustrates the signal generating portion of the system for applying an oscillating signal to lead 30 of cable pair 29. Square wave generator 40 comprises a relaxation oscillator circuit comprising transistors Q1, Q2 and Q3 the output of which is applied to flip flop Z1 for generating square wave outputs on Q and Q/ which are one hundred eighty degrees out of phase from one another.

The output from the Q/ output of flip flop Z1 on lead 41 is applied to a level shifter circuit 42 which insures that the square wave signal applied to its input on lead 41 appears as a square wave signal symmetrical about a zero reference level. Such output appears on lead 43 and is applied to a current driver circuit which converts the voltage signal on lead 43 to a current limited drive signal on lead 30. Also shown on FIG. 3 is a second flip flop Z2 the inputs of which are applied from outputs of flip flop Z1 such that the outputs of flip flop Z2 on leads 44 and 45 are square wave signals either leading by ninety degrees the square wave output on lead 41 or lagging the square wave on lead 41 by ninety degrees. The square wave on lead 44 leads that on lead 41 while the square wave generated on lead 45 lags by ninety degrees that on lead 41.

Turning now to FIG. 4, the interpretation circuitry of the system is illustrated. The output signal on lead 31 returning from the remote location is applied to a receiver amplifier integrater circuit 50. The current signal returning on lead 31 is converted to a voltage signal across resistor 110. The square wave voltage across resistor 110 is amplified and inverted by the receiver amplifier circuit 50 so that an amplified square wave signal appears on output lead 51 from the amplifier circuit. For the case where switch means 20 are closed and switch means 22 are open, only positive half cycles of the square wave applied on lead 30 are transmitted back to the central location on lead 31. For that situation where the switch means 20 is closed indicative that the element being sensed is in its first state, the positive half cycle signals on 31 are translated to negative half cycles appearing on lead 51. The transister Q5 translates those negative half cycles into positive half cycles on lead 61 at the collector of transister Q5. When the base of transister Q5 goes negative, the transister Q5 is turned off thereby driving the collector of Q5 to the voltage V1. Thus, the signal on lead 61 from the collector of transister Q5 is a doubly inverted representation of the positive pulses appearing on lead 31 and are applied to the D input of flip flop Z3. The trailing square wave output from flip flop Z2 on lead 45 is applied to the clock input of flip flop Z3.

Thus, so long as the positive pulses appear on lead 61 to the D input of flip flop Z3 the output Q of flip flop Z3 is a continuous output signal on lead 71 and indicates that switch means 20 are closed indicative that the element being sensed is in its first state.

Where the element is in its second state, the switch means 22 is closed and negative pulses of the square wave applied on conductor 30 are transmitted back to the central location via conductor 31. When negative pulses appear across resister R110 of receiver/amplifier integrater circuit 50, they are amplified and inverted on lead 51 to result in an inverted series of positive pulses corresponding to the negative pulses appearing on lead 31. The positive pulses on lead 51 are applied to a current limiting resister R50 and are clamped to voltage V1 and applied via lead 62 to the D input of flip flop circuit Z4. The leading square wave signal on lead 44 from the flip flop Z2 is applied to the clock input of flip flop Z4 with the result that the output Q of flip flop Z4 on lead 72 has a second continuous output signal on it so long as the positive pulses on lead 62 are present.

Thus, a continuous output voltage on lead 71 is present whenever the switch means 20 are closed, indicative that the element being sensed is in its first state, and a continuous output voltage on lead 72 is present whenever the switch means 22 are closed, indicative that the element being sensed is in its second state. When the element being sensed is in transit between the first and second states, no output is generated and no continuous output voltage on either lead 71 or 72 is generated.

The lamp driver circuitry 80 provides an emitter follower circuit for each of the voltages appearing on leads 71 and 72. Transister Q4 has its base connected to lead 71 and generates a current to the control terminal of triac Q7 whenever a voltage on lead 71 appears. When the control terminal of triac Q7 has a current applied to it the lamp LC is lighted because the triac then provides an alternating current path in the closed circuit of the lamp and the alternating voltage source VAC and ground.

In like manner, the transister Q3 has its base connected to lead 72 and a current signal is applied to the control terminal of triac Q6 thereby providing a closed circuit through the triac and the lamp LC and the voltage source VAC thereby lighting the lamp LC. Thus, when a control voltage appears on lead 72 indicative that the switch means 22 are closed, lamp LO is lighted, while a continuous voltage on lead 71 indicative that switch means 20 is closed lights lamp LC. Light emitting diodes CR7 and CR8 provide auxiliary means for indicating the status of the switch means 20 or 22 and are useful for providing a technician on a printed card an indication that the corresponding lamps are being lit. Neither lamp LC nor lamp LO is lit when the element being sensed is in transit between its first and second states or in other words, is in a third state.

Various modifications and alterations in the described circuitry and system will be apparent to those skilled in the art of the foregoing description which does not depart from the spirit of the invention. For this reason, these changes are desired to be included in the appended claims. The appended claims recite the only limitation to the present invention and the descriptive manner which is employed for setting forth the embodiments and is to be interpreted as illustrative and not limitative.

What is claimed is:

1. An indicator system for remotely sensing and indicating first and second status conditions of a two state element comprising:

a first switch means responsive to the two state element for closing when the element is in a first state and for opening when the element is in a second state, a second switch means responsive to the element for opening when the element is in a first state and for closing when the element is in a second state, a first diode means connected in series with the first switch means for conducting only current of a first direction through the closed first switch means, a second diode means connected in series with the second switch means for conducting only current of a second direction through the closed second switch means, the first diode-first switch series connection connected in parallel with the second diode-second switch series connection forming a parallel connection, a first conductor connected to one end of the parallel connection and a second conductor connected to the other end of the parallel connection, the first and second conductors extending from the location of the remotely disposed element to a central location, circuit means disposed at the central location for applying a driving oscillating signal that is substantially symmetrical about a reference level to the first conductor, circuit means disposed at the central location responsive to half cycles of a first direction on the second conductor for generating a first continuous output signal indicative that the element is in the first state, and circuit means disposed at the central location responsive to half cycles of a second direction on the second conductor for generating a second continuous output signal indicative that the element is in the second state.

2. The indicator of claim 1 further comprising, a first lamp circuit means responsive to said first continuous output signal when present for lighting a first lamp means indicative that the element is in the first state, and a second lamp circuit means responsive to said second continuous output signal for lighting a second lamp means indicative that the element is in the second state.

3. The indicator system of claim 1 wherein the two state element is a valve operator stem of a subsea valve, wherein the stem is in a first state when the valve is closed and in the second state when the valve is open.

4. The indicator system of claim 3 wherein the first and second switch means each comprise at least one reed switch, the first and second switch means being disposed axially apart in a housing through which the valve stem moves axially from the valve open state to the valve closed state, the valve operator stem including two magnets, wherein in the open state of the valve, one magnet of the valve operator stem is disposed adjacent the second switch means, the magnet acting to close only the second switch means, and in the closed state of the valve, the other magnet of the valve operator stem is disposed adjacent the first switch means, acting to close only the first switch means.

5. The indicator system of claim 4 wherein the first and second switch means are each a set of four reed switches comprising a series connection of two groups of two parallel connected switches.

6. The indicator system of claim 4 wherein the first diode means is a set of four diodes comprising a parallel connection of two sets of two series connected diodes, the diodes connected to conduct current of a positive direction but to prevent current of a negative direction through the first switch means.

7. The indicator system of claim 4 wherein the second diode means is a set of four diodes comprising a parallel connection of two sets of two series connected diodes, the diodes connected to conduct current of a negative direction but to prevent current of a positive direction through the second switch means.

8. The indicator system of claim 1 in which the circuit means for applying an oscillating signal to the first conductor comprises, an oscillator circuit means for generating a rectangular signal, a flip flop means responsive to the rectangular signal for generating a square wave signal, a level shifter means responsive to the square wave signal for generating a square wave signal substantially symmetrical about a reference level, and a current limited driver means responsive to the symmetrical square wave signal for generating an oscillating current signal substantially symmetrical about a reference level.

9. The indicator system of claim 1 in which the circuit means for generating a first continuous output signal comprises, an inverter/amplifier circuit means for inverting and amplifying the half cycles of a positive direction received on the second conductor indicative that the element is in the first state, the output of said inverter circuit being negative half cycles corresponding to said positive half cycles, a level shifter circuit means responsive to said negative half cycles for generating a doubly inverted positive half cycle signal, a quadrature signal generator means responsive to said driving oscillating signal that is substantially symmetrical about a reference level for generating a lagging oscillating signal that is ninety degrees trailing behind said driving oscillating signal, and a flip flop circuit means responsive to said lagging oscillating signal and to said doubly inverted positive half cycle signal for generating said first continuous output signal indicative that the element is in the first state so long as said doubly inverted positive half cycle signal is present.

10. The indicator system of claim 1 in which the circuit means for generating a second continuous output signal comprises, an inverter/amplifier circuit means for inverting and amplifying the half cycles of a negative direction received on the second conductor indicative that the element is in the second state, the output of said inverter circuit being an inverted signal of positive half cycles corresponding to said negative half cycles, limiter circuit means for generating a clamped inverter signal by clamping the amplitude of the inverted signal of positive half cycles to a prespecified level, a quadrature signal generator means responsive to said driving oscillating signal that is substantially symmetrical about a reference level for generating a leading oscillating signal which is ninety degrees ahead of said driving oscillating signal, and a flip flop circuit means responsive to said leading oscillating signal and to said clamped inverted signal for generating said second continuous output signal indicative that the element is in the second state.

11. The indicator system of claim 2 wherein said first lamp means comprises a first lamp in a first closed circuit with an alternating cycle voltage source and a first triac element, and wherein said first continuous output signal when present is applied to a first emitter follower circuit, the output of which is applied to the control terminal of the first triac element, for allowing alternating current to flow in said closed first series circuit and lighting the lamp indicating that the element is in the first state, and said second lamp means comprises a second lamp in a second closed circuit with said alternating cycle voltage source and a second triac element, and wherein said second continuous output signal when present is applied to a second emitter follower circuit, the output of which is applied to the control terminal of the second triac element, for allowing alternating current to flow in said closed second series circuit and lighting the lamp indicating that the element is in the second state.

12. An indicator system for remotely sensing and indicating first, second and third conditions of a three state element comprising, a first switch means responsive to the three state element for closing when the element is in a first state and for opening when the element is in a second or third state, a second switch means responsive to the three state element for closing when the element is in a second state and for opening when the element is in a first or third state, a first diode means connected in series with the first switch means for conducting only positive current through the first switch means when said first switch means is closed, a second diode means connected in series with the second switch means for conducting only negative current through the second switch means when said second switch means is closed, the first diode-first switch series connection connected in parallel with the second diode-second switch series connection forming a parallel connection, a first conductor connected to one end of the parallel connection and a second conductor connected to the other end of the parallel connection, the first and second conductors extending from the location of the remotely disposed element to a central location, circuit means disposed at the central location for applying a driving oscillating signal that is substantially symmetrical about a reference level to the first conductor, circuit means disposed at the central location responsive to positive half cycles on the second conductor for generating a first continuous output signal indicative that the element is in the first state, circuit means disposed at the central location responsive to negative half cycles on the second conductor for generating a second continuous output signal indicative that the element is in the second state, and wherein neither the first continuous output signal nor the second continuous output signal are generated when the element is in the third state.

13. The system of claim 12 further comprising a first lamp circuit means responsive to said first continuous output signal when present for lighting a first lamp means indicative that the element is in the first state, a second lamp circuit means responsive to said second continuous output signal for lighting a second lamp means indicative that the element is in the second state, and wherein the absence of lighting of the first lamp means and the second lamp means is indicative that the element is in the third state.

14. The system of claim 12 wherein the three state element is a valve operator stem of a subsea valve, wherein the stem is in a first state when the valve is closed, in a second state when the valve is open, and in a third state when the valve is in transit between being open and closed.

15. The system of claim 14 wherein the first and second switch means each comprise at least one reed switch, the first and second switch means being disposed axially apart in a housing through which the valve stem moves axially from the valve open state to the valve closed state, the valve operator stem including two magnets, wherein the open state of the valve, a magnet of the valve operator stem is disposed adjacent the second switch means, the magnet acting to close only the second switch means, and in the closed state of the valve, the other magnet of the valve operator stem is disposed adjacent the first switch means, acting to close only the first switch means, and when the valve is in transit between being open and closed, the magnets of the valve operator stem are displaced either side of the first switch means and the second switch means whereby neither the first switch means nor the second switch means are closed.

16. The system of claim 15 wherein the first and second switch means are each a set of four reed switches comprising a series connection of two groups of two parallel connected switches.

17. The system of claim 15 wherein the first diode means is a set of four diodes comprising a parallel connection of two sets of two series connected diodes, the diodes connected to conduct positive current but to prevent negative current current through first switch means.

18. The system of claim 15 wherein the second diode means is a set of four diodes comprising a parallel connection of two sets of two series connected doides, the diodes connected to conduct negative current but to prevent positive current through the second switch means.

19. The system of claim 13 in which the circuit means for applying an oscillating signal to the first conductor comprises, an oscillator circuit means for generating a rectangular signal, a flip flop means responsive to the rectangular signal for generating a square wave signal, a level shifter means responsive to the square wave signal for generating a square wave signal substantially symmetrical about a reference level, and a current limited driver means responsive to the symmetrical square wave signal for generating an oscillating current signal substantially symmetrical about a reference level.

20. The system of claim 13 in which the circuit means for generating a first continuous output signal comprises, an inverter/amplifier circuit means for inverting and amplifying the positive half cycles received on the second conductor indicative that the element is in the first state, the output of said inverter circuit being negative half cycles corresponding to said positive half cycles, a level shifter circuit means responsive to said negative half cycles for generating a doubly inverted positive half cycle signal, a quadrature signal generator means responsive to said driving oscillating signal that is substantially symmetrical about a reference level for generating a lagging oscillating signal that is ninety degrees trailing behind said driving oscillating signal, and a flip flop circuit means responsive to said lagging oscillating signal and to said doubly inverted positive half cycle signal for generating said first continuous output signal indicative that the element is in the first state so long as said doubly inverted positive half cycle signal is present.

21. The system of claim 13 in which the circuit means for generating a second continuous output signal comprises, an inverter/amplifier circuit means for inverting and amplifying the negative half cycles received on the second conductor indicative that the element is in the second state, the output of said inverter circuit being an inverted signal of positive half cycles corresponding to said negative half cycles, limiter circuit means for generating a clamped inverter signal by clamping the amplitude of the inverted signal of positive half cycles to a prespecified level, a quadrature signal generator means responsive to said driving oscillating signal that is substantially symmetrical about a reference level for generating a leading oscillating signal which is ninety degrees ahead of said driving oscillating signal, and a flip flop circuit means responsive to said leading oscillating signal and to said clamped inverted signal for generating said second continuous output signal indicative that the element is in the second state.

22. The system of claim 15 wherein said first lamp means comprises a first lamp in a first closed series circuit with an alternating cycle voltage source and a first triac element, and wherein said first continuous output signal when present is applied to a first emitter follower circuit, the output of which is applied to the control terminal of the first triac element, for allowing alternating current to flow in said closed first series circuit and lighting the lamp indicating that the element is in the first state, and said second lamp means comprises a second lamp in a second closed series circuit with said alternating cycle voltage source and a second triac element, and wherein said second continuous output signal when present is applied to a second emitter follower circuit, the output of which is applied to the control terminal of the second triac element, for allowing alternating current to flow in said closed second series circuit and lighting the lamp indicating that the element is in the second state, and wherein when the element is in the third state, no continuous output signal is applied to either the control terminal of the first triac element or to the control terminal of the second triac element and neither the first lamp nor the second lamp is lit.

* * * * *